US005899868A

United States Patent [19]

VandeBerg

[11] Patent Number: 5,899,868

[45] Date of Patent: May 4, 1999

[54] DEEP MUSCLE KNOT-RELAXING DEVICE AND METHOD

[76] Inventor: Martha E. VandeBerg, 2572 Oak Forest, Holland, Mich. 49424

[21] Appl. No.: 08/708,374

[22] Filed: Sep. 4, 1996

Related U.S. Application Data

[ 60] Provisional application No. 60/004,302, Sep. 26, 1995.

[51] Int. Cl.[6] ..... A61H 7/00

[52] U.S. Cl. ..... 601/134; 601/28; 601/136; D24/211; 606/204

[58] Field of Search ..... 601/134–138, 601/107, 95, 103, 111, 28; 606/204; D24/211, 212, 214, 215, 200

[56] References Cited

U.S. PATENT DOCUMENTS

| | | | |
|---|---|---|---|
| D. 244,871 | 6/1977 | Vincenti . | |
| 1,510,647 | 10/1924 | Bomar . | |
| 1,613,158 | 1/1927 | Brewer . | |
| 1,953,798 | 4/1934 | Grandcourt . | |
| 1,954,940 | 4/1934 | Mikel . | |
| 1,981,379 | 11/1934 | Thomson et al. | 601/28 X |
| 2,742,251 | 4/1956 | Udvardy . | |
| 2,836,175 | 5/1958 | Nakayama . | |
| 3,577,985 | 5/1971 | Guffin . | |
| 3,612,044 | 10/1971 | Gurrola . | |
| 4,003,372 | 1/1977 | Willoby | 601/28 |
| 4,126,129 | 11/1978 | Rainbow . | |
| 4,207,878 | 6/1980 | Duncan . | |
| 4,233,966 | 11/1980 | Takahashi . | |
| 4,520,798 | 6/1985 | Lewis . | |
| 4,974,582 | 12/1990 | Johnson . | |
| 5,056,507 | 10/1991 | Yum . | |
| 5,096,188 | 3/1992 | Shen . | |

FOREIGN PATENT DOCUMENTS

| | | | |
|---|---|---|---|
| 1128081 | 4/1962 | Germany | 601/28 |
| 2136590 | 2/1973 | Germany . | |
| 1544428 | 2/1990 | U.S.S.R. | 601/134 |
| 1410944 | 10/1975 | United Kingdom . | |

*Primary Examiner*—Danton D. DeMille
*Attorney, Agent, or Firm*—Van Dyke, Gardner, Linn & Burkhart, LLP

[57] ABSTRACT

A deep muscle knot relaxing device and corresponding method is advanced comprising a flat base from which extends two or more protuberances positioned a fixed distance apart. The protuberances are substantially hemispherical in shape and are of different heights and diameter, enabling the protuberances to be properly matched with the muscle knot characteristics of the user. The base may be formed with a plurality of through openings to prevent the buildup of hydrostatic pressure under the base when used in a bathtub. The base and protuberances are preferably integrally formed in a single molding process with sufficient spacing between the protuberances so as to discourage the user from using more than one protuberance at a time. The surface of the base opposing the protuberances may be equipped with an anti-skid surface, thereby preventing movement of the device during therapy.

11 Claims, 3 Drawing Sheets

DEEP MUSCLE KNOT-RELAXING DEVICE AND METHOD

This application claim benefit of provisional application 60/004,302 filed Sep. 26, 1995.

BACKGROUND OF THE INVENTION

This invention relates generally to a deep muscle knot-massaging device and, in particular, to a self application device and to a method of deep muscle knot relaxation. The invention is adapted for use in petrissage, cross-fiber friction, and other deep muscle massage techniques.

The loss of mobility and flexibility in a muscle and a decrease in blood circulation can contribute to the presence of painful muscular knots, or trigger points. These knots are muscle fibers in body tissues that are stuck together instead of contracting and relaxing smoothly. Various self-application massage devices have been proposed. Most such devices are manipulated by hand and include surfaces for massaging deep muscle knots in order to apply deep fibers spreading to the knot and thereby provide relief from the pain associated with the knot. The difficulty with hand-manipulated massaging devices is that the user may be unable to apply sufficient pressure to the knot or may be unable to reach the knot at all. An additional difficulty with relaxing deep muscle knots is that the makeup of the knot varies, for example, in density, depth, and other parameters. Therefore, the application of self-massage utilizing a hand-manipulated device typically utilizes a massaging surface which may be appropriate for certain knot characteristics but may be inappropriate for knots having other characteristics.

Although muscle-knot relaxation techniques typically involve the unilateral application of pressure, professional therapists often apply bilateral pressure to symmetrical portions of the body in order to magnify the therapeutic effect if necessary. However, the application of bilateral pressure is not recommended unless bilateral knotting is present. Furthermore, application of bilateral pressure is capable of exceeding the patient's pain tolerance. Bilateral pressure should be applied only by a professional therapist. The use of a self-administered deep muscle knot-relaxing massage should avoid the application of bilateral pressure.

SUMMARY OF THE INVENTION

The present invention provides temporary or permanent relief from the pain of deep muscle knots by providing a device that is capable of applying deep pressure to compress the muscular tissues of a deep muscle knot and, thereby, help to relax the tightened areas. The invention provides a device and method of use which is capable of applying appropriate pressure to match the characteristics of the user's deep muscle knot and does so in a manner which discourages the application of bilateral pressure to the user's body.

The present invention provides two or more protuberances secured to a back-plane and spaced apart a distance that is sufficient to allow only one of the protuberances to be juxtaposed with the patient's body at a time. Because of this spacing, the user is discouraged from applying bilateral pressure by juxtaposing more than one of the protuberances with the user's body at a time. Advantageously, this allows the protuberances to have different shapes, and, in particular, different heights and radii, which allows the protuberances to be properly matched with the deep muscle knot characteristics of the user. In particular, a protuberance having a larger radius and/or shorter height may be applied to deep muscle knots which are wide and shallow, while a protuberance having a smaller radius and/or longer height may be applied to knots which are more deeply positioned within the user.

Each protuberance is preferably manufactured from a polymeric material having sufficient rigidity to apply compression to the user's muscular knot, but having a degree of flexibility. This flexibility reduces the risk that the device may bruise or otherwise injure the user.

The protuberances are preferably mounted to a flat base and, most preferably, are molded as a unitary article with the protuberances and the base molded of the same material. The base may include a plurality of through-openings in order to prevent the buildup of hydrostatic pressure under the base. Additionally, baby oil or the like is placed on the protuberance and then into the water. Alternatively, an anti-skid means, such as an anti-skid surface, may be applied opposite the protuberances in order to assist in avoiding movement of the device during therapy but allowing ease of movement to reposition the device between treatments. While use of the device in a warm-water bath may assist in releasing the tightened areas, a device according to the invention may be utilized in other manners. For example, the protuberances may be coated with a lubricant, such as baby oil, cocoa butter, and used outside of water. The device could be positioned on a flat horizontal surface, such as a chair, in order to allow deep muscle knots in the large leg muscles or the buttocks area to be relaxed. Additionally, a lubricant may be applied to the skin of the user and the device used in or out of warm water.

Because the user manipulates the body on the device, rather than hand-manipulating a device to the body, a force sufficient to apply deep pressure to compress the muscle tissue may be developed. The user is able to regulate the amount of pressure consistent with that user's pain tolerance. Because the application of bilateral pressure to bilateral areas is avoided, the user is inhibited from using the device to apply bilateral pressure which may cause the user's pain tolerance to be exceeded.

These and other objects, advantages, and features of this invention will become apparent upon review of the following specification in conjunction with the drawings.

DESCRIPTION OF THE PREFERRED EMBODIMENT

Figure 3:
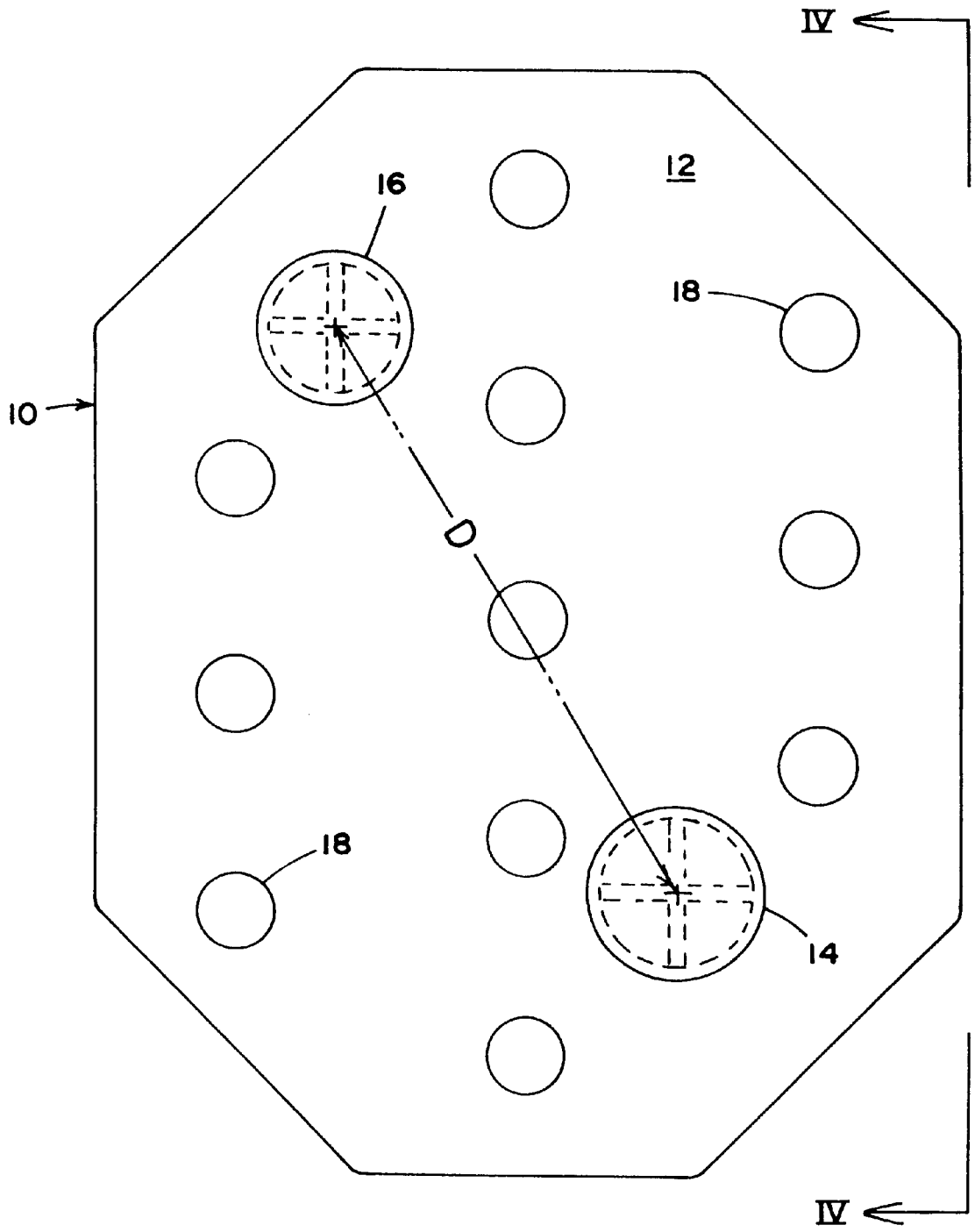
FIG. 3 is a plan view of the device in FIG. 1.

Referring now specifically to the drawings, and the illustrative embodiments depicted therein, a deep muscle knot-relaxing mat, or device, generally illustrated at 10, includes a flat base, or backplane, 12, a first protuberance 14, and second protuberance 16. In the illustrated embodiment, protuberances 14 and 16 are substantially hemispherical in shape and are integrally formed with base 12 from a common material in a single-molding process. However, it is possible for protuberances 14, 16, to be separately formed and attached to base 12. This would allow the protuberances to be made from a different material than that used for base 12. Protuberances 14, 16 are excavated with support webbing as seen in FIG. 3. In the illustrative embodiment, protuberances 14, 16 and base 12 are made from a polymeric material that is rigid but has a degree of flexibility. An example of such material is Ciba-Geigy Corporation RP 6400-1 polyurethane. However, other polymeric materials having similar hardness characteristics may be utilized. In a preferred embodiment, mat 10 is injection-molded using Sarlink 3150 elastomers.

In the illustrative embodiment, protuberance 14 has a radius of 0.88 inches and protuberance 16 has a radius of 0.75 inches. Although having a smaller radius, protuberance 16 has a height that is greater than that of protuberance 14. In the illustrated embodiment, the height of protuberance 16 is one inch while the height of protuberance 14 is 0.88 inches. The dimensions of each protuberance allows that protuberance to more effectively apply deep pressure compression to deep muscle knots having different characteristics. Because of its relatively greater height and smaller radius, protuberance 16 is more useful at compressing knots which are deeper within the interior of the user's body. In contrast, protuberance 14, which is shorter and has a larger radius, is more useful for shallow knots which are closer to the surface of the user's body.

Figure 1:
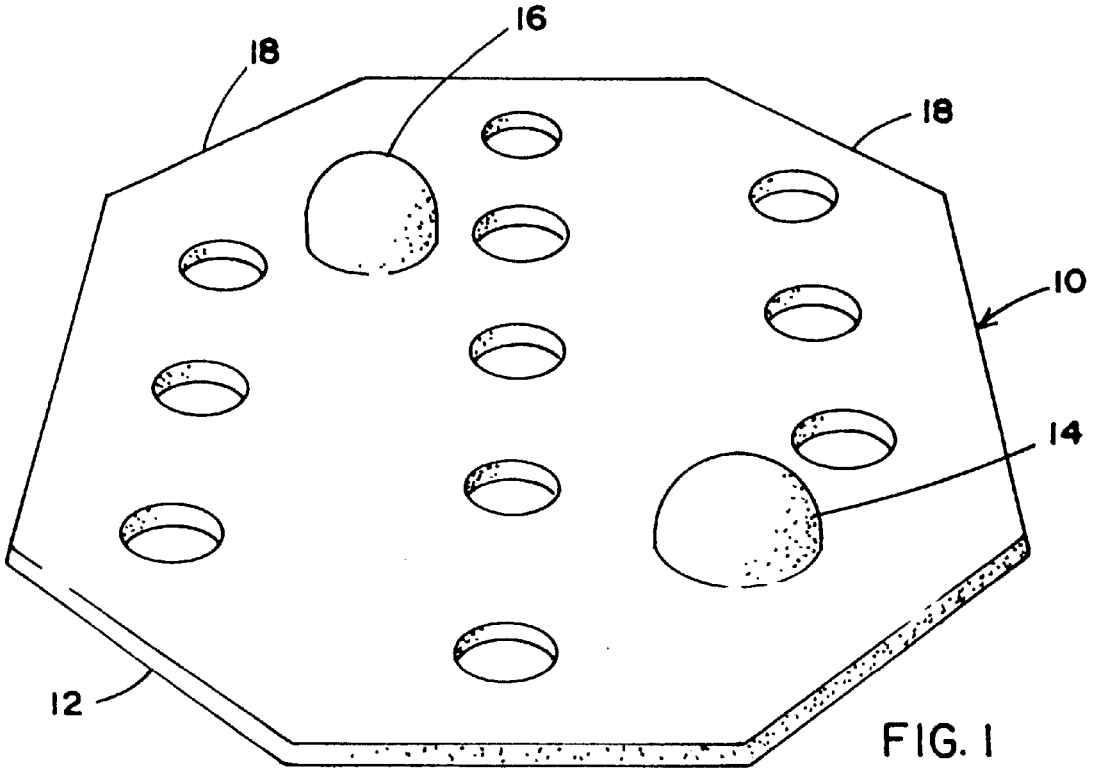
FIG. 1 is a perspective view of a deep muscle knot-relaxing device according to the invention.
Figure 2:
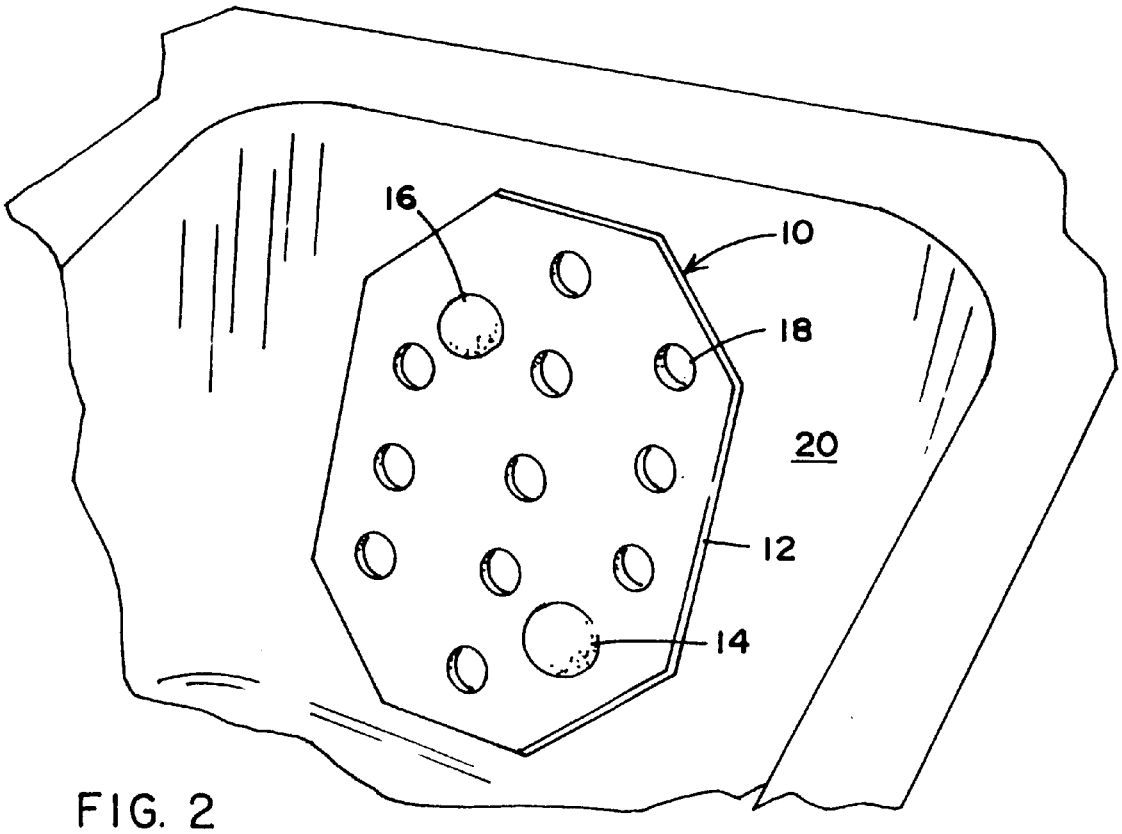
FIG. 2 is a perspective view of the device in FIG. 1 adhered to the wall of a bathtub.

Deep muscle knot-relaxing device 10 further includes a plurality of through-openings 18 in base 12. Through-openings 18 reduce the buildup of hydrostatic pressure between base 12 and a support surface when used in a warm-water bath, as illustrated in FIG. 2. Referring to FIG. 2, deep muscle-relaxing device 10 may be adhered to a sidewall 20 of a bathtub 22. This allows the user to compress deep muscle knots in the user's back and neck. In order to resist movement of device 10 during therapy, but allow ease of movement when desired for repositioning, a rear surface 24, opposite protuberance 14, 16, may be imparted with anti-skid characteristics of those well known in the art.

Figure 5:
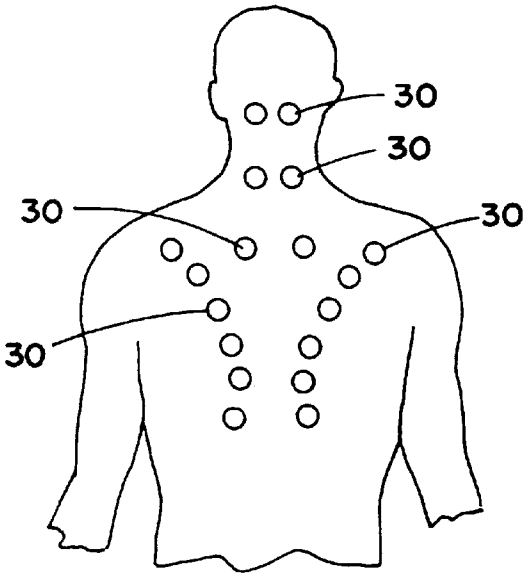
FIG. 5 is a diagram of a human torso illustrating trigger points which the invention is especially useful for relaxing.
Figure 4:
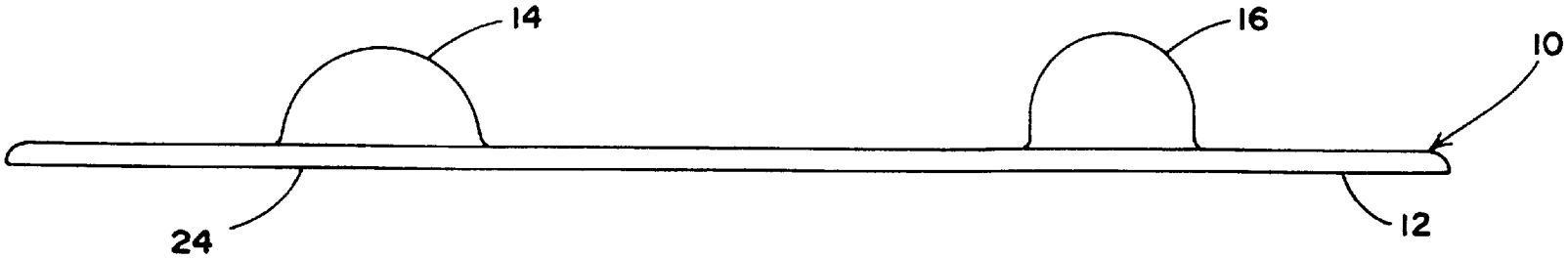
FIG. 4 is a side view taken in the direction IV—IV in FIG. 3.

Protuberances 14 and 16 are separated by a distance D which is selected to be sufficient to discourage the use of more than one protuberance at a time to apply deep muscle knot compression. Such separation inhibits the user from attempting to apply pressure to bilateral areas, which may result in the user exceeding his or her pain threshold. In this manner, the user is able to more accurately monitor pain tolerance as deep muscle knot compression is being applied. In the illustrated embodiment, distance D is preferably approximately 8 inches but may be selected from the range of between approximately 6 inches and approximately 10 inches. Although two protuberances, which are widely spaced, are illustrated in the preferred embodiment, other applications may utilize more than two protuberances spaced apart in this manner. Deep muscle knot-relaxing knot 14 is especially useful for relaxing trigger-points 30 located along the neck, shoulder blades, and upper back (FIG. 5).

The rigid, yet pliant, characteristics of the material making up each protuberance allows the user to comfortably apply compression to the deep muscle knot while minimizing pain. Although deep muscle knot-relaxing device 10 may be utilized in a warm-water bath, it may additionally be utilized outside of a bath environment by applying a lubricant, such as cocoa butter or the like, to the protuberances. For example, compression may be applied to the large muscles in the back of the user's leg or in the user's buttocks by placing device 10 on the seat of a chair and the user applying their weight in order to provide force between a protuberance and a deep muscle knot of the user. It should be understood that, in order to advantageously use one of protuberances 14, 16 to apply compression to a particular area of the user, it may be desirable to relocate the position of device 10, such as by rotation of the base, by lateral movement of the base, or both.

Deep muscle knot-relaxing device 10 may be utilized to apply different forms of therapy to release tightened areas of the user. For example, device 10 may be utilized to apply petrissage, which is a circular motion, to the knot. Additionally, device 10 may be utilized to apply cross-fiber manipulation, Storm's technique, Syriax's friction, and other known therapeutic techniques to treat the user's deep muscle knot.

Changes and modifications in the specifically described embodiments can be carried out without departing from the principles of the invention, which is intended to be limited only by the scope of the appended claims, as interpreted according to the principles of patent law including the doctrine of equivalents.

The embodiments of the invention in which an exclusive property or privilege is claimed are defined as follows:

1. A method of relaximg deep muscle knots, including:

providing a device having a flexible, generally plan backplane and at least two protuberances supported on a surface of said backplane in spaced apart relationship, said protuberances being spaced apart sufficiently to discourage a user from applying more than one of said protuberances at a time to the user's body to relax a knot wherein one of said protuberances has a greater height and a smaller diameter than the other of said protuberances wherein said backplane and said at least two protuberances are integrally formed in a molding process and wherein said protuberances are excavated and include support webbing;

positioning said device on a support surface and pressuring a deep muscle knot over one of said protuberances in order to apply compression to deep muscle knots one at a time wherein said pressuring includes pressuring a knot which is deep within the interior of the user's body to said one of said protuberances.

2. The method in claim 1 including positioning said device in warm water.

3. The method in claim 1 including applying a lubricant between the deep muscle knot and one of said protuberances.

4. The method in claim 1 wherein said pressuring includes pressuring a knot located in the user's neck, shoulders or upper back.

5. The method as recited in claim 1, wherein one of said protuberances has a lesser height and a greater diameter than the other of said protuberances and wherein said pressuring includes pressuring a knot which is close to the surface of the user's body to said one of said protuberances.

6. A deep muscle not-relaxing device, comprising:

a generally planar backplane; and at least two protuberances supported on a surface of said backplane in spaced apart relationship, said protuberances having different heights and diameters and being spaced apart sufficiently to discourage a user from applying more than one of said protuberances at a time to the user's body to relax a knot; one of said protuberances having greater height and smaller diameter than the other of said protuberances; wherein said backplane and said at least two protuberances are integrally formed in a molding process and wherein said protuberances are excavated and include support webbing.

7. The device in claim 6 wherein said protuberances are spaced apart at least approximately 6 inches.

8. The device in claim 7 wherein said protuberances are spaced apart at least approximately 8 inches.

9. The device in claim 6 including means defining holes through said backplane.

10. The device in claim 6 including means defining a nonskid surface on said backplane opposite said protuberances.

11. The device in claim 6 wherein said backplane and said protuberances are injection-molded.

* * * * *

UNITED STATES PATENT AND TRADEMARK OFFICE

CERTIFICATE OF CORRECTION

PATENT NO. : 5,899,868
DATED : May 4, 1999
INVENTOR(S) : Martha E. VandeBerg

It is certified that error appears in the above-identified patent and that said Letters Patent is hereby corrected as shown below:

Column 4, claim 1, line 21:
"relaximg" should be --relaxing--.

Column 4, claim 1, line 22:
"plan" should be --planar--.

Column 4, claim 6, line 54:
"not-relaxing" should be --knot-relaxing--.

Signed and Sealed this

Seventh Day of December, 1999

*Attest:*

Q. TODD DICKINSON

*Attesting Officer*

*Acting Commissioner of Patents and Trademarks*